US005367120A

United States Patent [19]

Hoshiai

[11] Patent Number: 5,367,120

[45] Date of Patent: Nov. 22, 1994

[54] MUSICAL TONE SIGNAL FORMING DEVICE FOR A STRINGED MUSICAL INSTRUMENT

[75] Inventor: Atsushi Hoshiai, Hannan, Japan

[73] Assignee: Roland Corporation, Osaka, Japan

[21] Appl. No.: 924,979

[22] Filed: Aug. 5, 1992

[30] Foreign Application Priority Data

Oct. 1, 1991 [JP] Japan ..... 3-282124

[51] Int. Cl.[5] ..... G10H 5/00

[52] U.S. Cl. ..... 84/654; 84/736; 84/616

[58] Field of Search ..... 84/723, 735–737, 84/455, 616, 654, 681, DIG. 9

[56] References Cited

U.S. PATENT DOCUMENTS 4,688,464 8/1987 Gibson et al. ..... 84/454
5,202,528 4/1993 Iwaooji ..... 84/616

FOREIGN PATENT DOCUMENTS 3137395 6/1988 Japan .
3179399 8/1991 Japan .

*Primary Examiner*—William M. Shoop, Jr.
*Assistant Examiner*—Jeffrey W. Donels
*Attorney, Agent, or Firm*—Wegner, Cantor, Mueller & Player

[57] ABSTRACT

A musical tone signal forming device for an electric string music instrument having at least one pickup for detecting and delivering vibration of a string as an electric musical sound signal, including at least one comb filter having the electric musical sound signal as an input thereof; and structure for producing parameters corresponding to a specific position, which differs from a position of the pickup with respect to the string, at which an imaginary pickup is disposed and a reference vibration frequency of the string and supplying the parameters to the at least one comb filter to determine a frequency characteristic of the at least one comb filter, wherein the frequency characteristic of the at least one comb filter simulates a frequency characteristic of the electric musical sound signal delivered from the imaginary pickup disposed at the specific position.

24 Claims, 3 Drawing Sheets

MUSICAL TONE SIGNAL FORMING DEVICE FOR A STRINGED MUSICAL INSTRUMENT

BACKGROUND OF THE INVENTION

This invention relates to a timbre forming device for electric or electronic music instruments and, especially, to a device for freely forming timbre of electric string music instruments such as electric guitars.

For example, such an electronic music instrument as disclosed in the opened Japanese patent gazette No. S63-137295, which is referred to as "guitar synthesizer", is arranged to detect a pitch from a string vibration signal in a control unit and produce a musical sound from a sound source based upon the pitch. In such guitar synthesizer, it has been a general practice to attach a pickup in the vicinity of a bridge for improving separation of adjoining strings and satisfying pitch detection. However, the string vibration signal detected by the pickup located in such position includes a lot of higher harmonic components and, therefore, it must be passed through highpass filter, lowpass filter, bandpass filter and the like for timbre formation before it is used. However, it is impossible to obtain such a good musical sound signal as detected by a pickup attached at a general position, by such conventional filters only.

As another way, it has been proposed to attach pickups for guitar synthesizer, that is, so called divided pickups which respectively correspond to the strings and can individually detect vibrations of the respective strings, in the vicinity of the bridge of a conventional electric guitar so that the electric guitar can be used as a controller of the guitar synthesizer, and to use as a string vibration signal the output signal of the original pickup of the electric guitar. However, this system has such a disadvantage as high cost and confinement of pickup attaching position.

Accordingly, an abject of this invention is to provide a timbre forming device which can produce, from a string vibration signal with a lot of higher harmonic components detected by divided pickups attached in the vicinity of the bridge, a musical sound signal having a timbre similar to what is obtained from a string vibration signal detected by a pickup attached in a general position.

Another abject of this invention is to provide a timber forming device which can freely change the timbre of the above-mentioned musical sound signal.

When a pickup is fixed with respect to a string, its output level becomes nearly zero for a vibration having its node at the position of the pickup and maximum for a vibration having its loop thereat. More specifically, the output has a wave-like frequency characteristic determined by the pickup position and, therefore, the resultant musical sound signal has a timbre which is different from a natural musical sound and peculiar to the musical instrument.

Accordingly, a further object of this invention is to provide a frequency characteristic compensation device which can remove the above-mentioned frequency characteristic from the string vibration signal detected by the pickup to produce a string vibration signal akin to a natural sound.

SUMMARY OF THE INVENTION

According to a feature of this invention, the timbre forming device includes a comb filter connected to the output of each pickup and the comb filter has a predetermined frequency characteristic.

According to another feature of this invention, the timbre forming device further includes means for changing the frequency characteristic of the comb filter.

According to a further feature of this invention, the timbre forming device is accompanied by a separate comb filter inserted between its input and the output of each pickup and the separate comb filter has a frequency characteristic opposite to the frequency characteristic of the output signal of the pickup.

Now, the description will be made on the above and other features and operations of the device of this invention with reference to the accompanying drawings in connection with some embodiments thereof.

BRIEF DESCRIPTION OF DRAWINGS

In the drawings.

Thoughout the drawings, the same reference numerals are given to corresponding structural components and no description will be repeated thereon.

DESCRIPTION OF PREFERRED EMBODIMENTS

Figure 1:
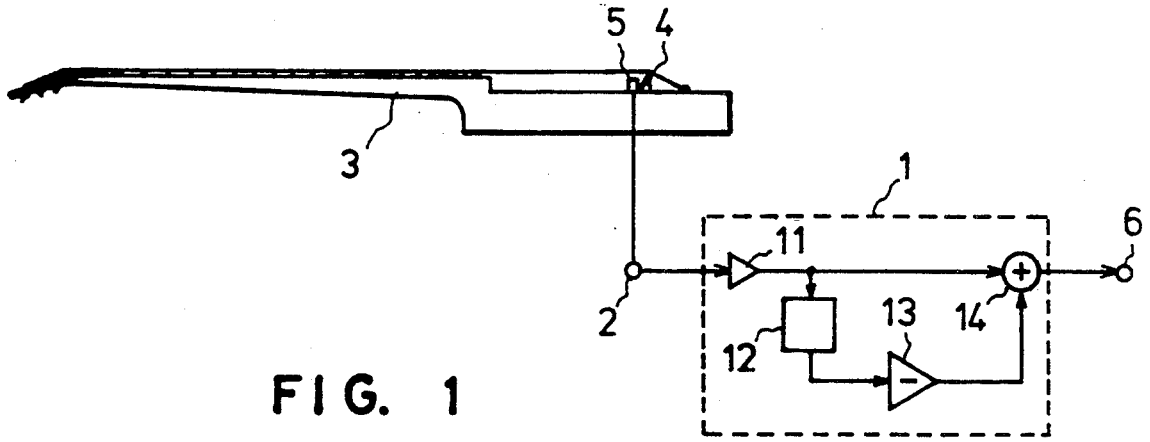
FIG. 1 is a block diagram showing an embodiment of the timbre forming device of this invention.

In FIG. 1, a timbre forming device 1 of this invention has an input terminal 2 connected to a divided pickups 5 and an output terminal 6 connected to a sound system including amplifier and speaker (not shown). As described above, the output signal of the pickup 5 includes a lot of higher harmonic components. While A/D and D/A convertors are needed respectively after the input terminal 2 and after the output terminal 6 in case of realizing the timbre forming device in digital form, no description will be made thereon.

Figure 2:
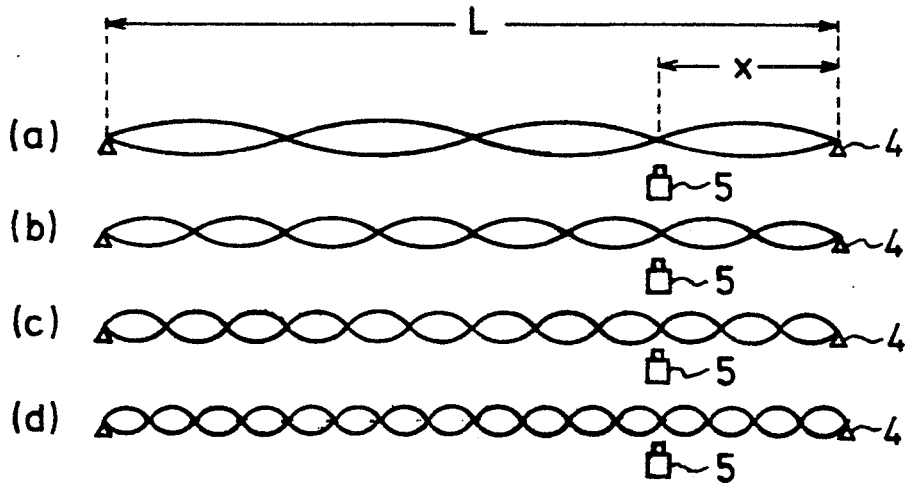
FIG. 2 is an explanatory diagram showing relationships between modes of string vibration and pickup position.
Figure 3:
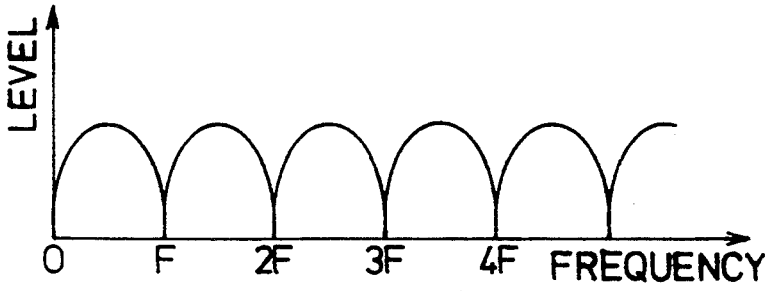
FIG. 3 is an exemplary diagram showing a frequency characteristic of the output signal of a pickup.

Generally speaking, when the pickup 5 is located at a position of distance x from a bridge 4, the pickup detects no string vibration signal having its node at this position. More specifically, the output level of the pickup 5 has a comb-like frequency characteristic, as shown in FIG. 3, which becomes nearly zero at frequencies corresponding to integral multiples of a fundamental frequency of string vibration having the distance x as a half of its wave-length. Such frequency characteristic can be simulated by a comb filter and, if the output signal of the pickup 5 is filtered by such comb filter, higher harmonic components having their nodes at the position of pickup 5 as shown in (a), (b), (c) and (d) of FIG. 2 are removed, so that the timbre varies and a musical sound signal is obtained as if it is detected by a pickup at another position. The timbre forming device 1 of FIG. 1 is composed of such comb filter.

Particularly, the comb filter 1 comprises a buffer amplifier 11 connected to the input terminal 2, a delay 12 connected to the output of the buffer amplifier 11 and an adder 14 having the outputs of buffer amplifier 11 and inversion amplifier 13 as its inputs and its output connected to the output terminal 6. The pickup 5 and comb filter (i.e., timbre forming device) 1 are provided for each of plural sound sources (six strings of the guitar, in this case).

The comb filter 1 has a frequency characteristic which has dips at frequencies corresponding to integral multiples of a fundamental frequency F, namely, 0F (d.c.), 1F, 2F, 3F, . . . as shown in FIG. 3 and the fundamental frequency F is determined by the delay time of the delay 12. Once the delay time of the delay 12 is adjusted to set the fundamental frequency so that a quarter of the of open string length L equals to a half wave-length, for example, as shown in FIG. 2, a musical sound signal, as if the pickup is located at a position of a quarter of the string length L, is obtained from each sound source, even from a string vibration signal having a lot of higher harmonics which is detected by the pickup 5 fixed in the vicinity of the bridge 4 as shown in FIG. 1.

As described above, it is possible to obtain a musical sound signal of any timbre by suitably presetting the delay time of the delay 12 of the comb filter 1 and, also, obtain various musical sound signals by connecting a plurality of separate timber correcting filters in series or parallel to the output terminal 6. For example, by connecting two other comb filters having different characteristics in series, it is possible to obtain a musical sound signal as obtained by a humbacking pickup or half-tone setting of an electric guitar. Half-tone setting of the guitar means a state of an electric guitar attached with single-coil pickups wherein a tone switch for switching the pickups is positioned at an intermediate position to connect the pickups in parallel.

Figure 4:
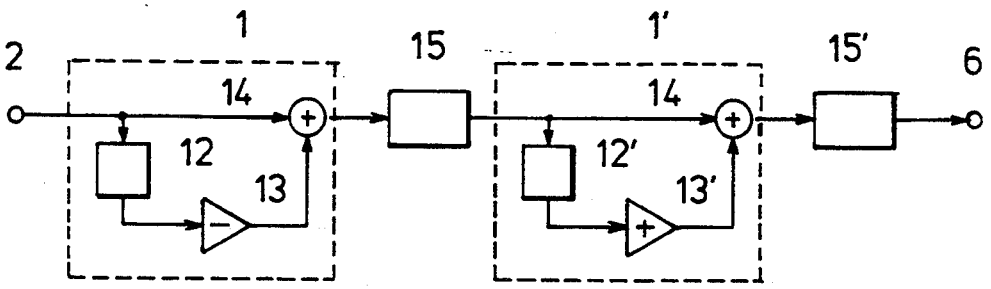
FIG. 4 is a block diagram showing another embodiment of the timbre forming device of this invention.

FIG. 4 shows an embodiment thereof. In this timbre forming device, two comb filters 1 and 1' are connected in series between the input and output terminals 2 and 6 through timbre correcting filters 15 and 15'. The first comb filter 1, which corresponds to the comb filter 1 of FIG. 1, has a frequency characteristic having dips at 0F (d.c.), 1F, 2F, 3F, . . . , the frequencies corresponding to integral multiples of the fundamental frequency F, as shown in FIG. 3. However, the second comb flter 1' includes a non-inversion amplifier 13' instead of the inversion amplifier 13 of the comb filter 1 of FIG. 1 and the delay time of the delay 12' thereof is preset so that the frequency characteristic has dips at 1F, 3F, 5F, . . . , the frequencies corresponding to odd multiples of the fundamental frequency F. The timbre correcting filters 15 and 15' are composed of suitable combination of lowpass, highpass and bandpass filters and well known by those skilled in the art, and it is possible to remove them in some cases. With this configuration, it is possible to obtain the above-mentioned musical sound signals of humbacking pickups and half-tone setting by suitably setting the delay times of the delays 12 and 12' of the comb filters 1 and 1'.

Figure 5:
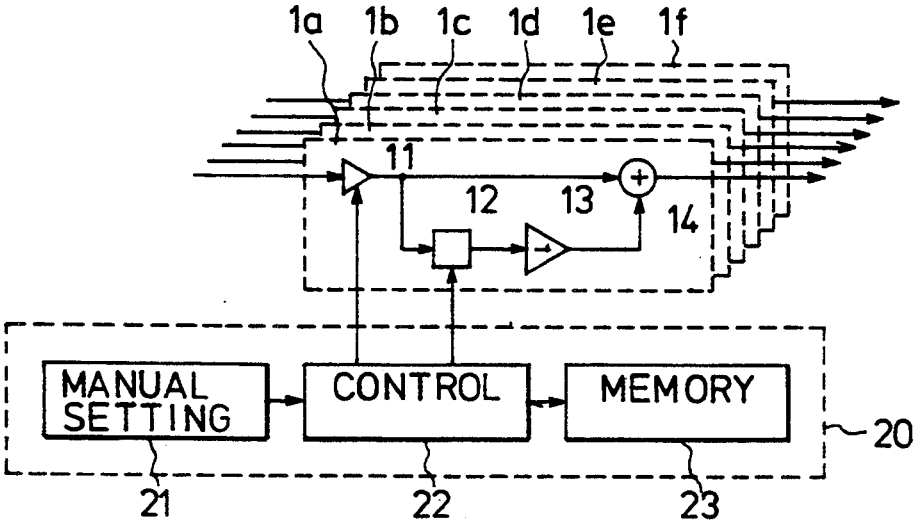
FIG. 5 is a block diagram showing a further embodiment of the timbre forming device of this invention.

While the frequency characteristics of the comb filters are fixed in the above embodiments, it is possible to freely obtain a further variety of timbre if they are made variable. FIG. 5 shows an embodiment of the timbre forming device, which is arranged in this manner.

In the drawing, 1*a*, 1*b*, 1*c*, 1*d*, 1*e* and 1*f* denote six comb filters correlated to six strings of an electric guitar, respectively, which constitute a timbre forming device of this embodiment. While each comb filter has a similar configuration to the comb filter of FIG. 1, the gain of its buffer amplifier 11 and the delay time of its delay 12 are made variable. These timber forming devices have a common parameter setting device 20 including manual setting means 21, control means 22 and memory means 23 and the control means 22 responds to an information optionally input from the manual setting means 21 to control the gain of the buffer amplifier 11 and the delay time of the delay 12 of each comb filter based upon a program stored in the memory means 23. Now, the description will be made only about control of the delay time of the delay 12, since gain control of the buffer amplifier 11 is effected only for level setting of the input signal and has no connection to the frequency characteristic of the comb filter.

As well known in the art, the delay 12 is arranged to sample its input signal at a sampling frequency $f_s$ to convert it into digital form, store the resultant data in a memory and read it after n samplings to obtain a delay time of $n*(1/f_s)$. If it is assumed that each comb filter has the frequency characteristic of FIG. 3 as the comb filter of FIG. 1 and the fundamental frequency F is $f_x$, the delay time to be set in the delay 12 is $1/f_x$. Accordingly, the number of samplings n corresponding to this time is given by the following equation.

$$n(1/f_x)/(1/f_s)=f_s/f_x \quad (1)$$

If this value n is given as an offset value of the read address of the delay memory, a desired delay time and, consequently, a desired frequency characteristic are obtained.

In practice, however, it is impossible to know the dip frequency $f_x$ directly from the input signal from the pickup. Therefore it is simpler to calculate $f_x$ from the fundamental frequency $f_0$ of the musical sound signal corresponding to the pickup position x and open string of FIG. 2. $f_x$ is given by the following equation, where L is the open string length.

$$f_x=f_0*(L/x)$$

Using this equation in Equation (1), then, $$n=f_s/f_x=(f_s/f_0)*(x/L) \quad (2)$$

While n is an interger here, a decimal n can be used by reading a plurality of sampling data and subjecting them to interpolation. In case of linear interpolation, for example, if n is a number a.b having a decimal point and two data $Y_1$ and $Y_2$ having offset addresses a and a+1, respectively, are read out and subjected to interpolation operation $Y_1*(1-0.b)+Y_2*0.b$, it will result in a delay signal.

The memory means 23 stores the above equations and informations constituting them, operational results, informations of respective comb filters and likes, and the manual setting means 21 serves to set these informations. For example, if Equation (1) and $f_s$ are previously stored in the memory means 23, it is enough to input $f_x$ from the manual setting means 21 and, if Equation (2), $f_s$, x and L, or the operational result of $f_s*(x/L)$ are stored in the memory means 23, it is enough to set only the value of $f_0$ by the manual setting means 21. If the value of x is made variable by the manual setting means 21, the pickup position can be changed.

Figure 6:
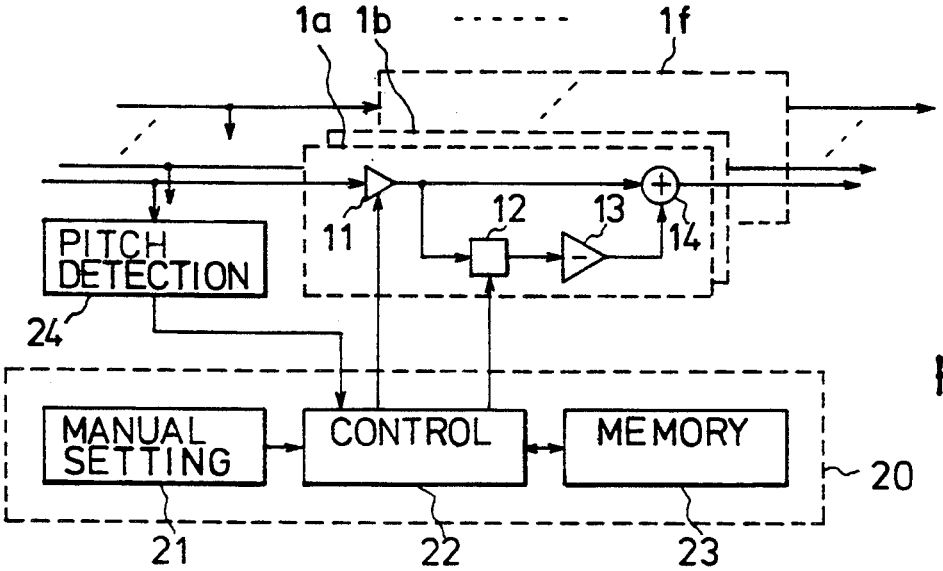
FIG. 6 is a block diagram showing a modified embodiment of the timbre forming device of FIG. 5, FIGS. 7 and 8 are block circuit diagrams showing a principle of operation of the frequency characteristic compensation device as shown in FIGS. 9 and on, FIG. 9 is a block diagram showing an embodiment of the frequency characteristic compensation device of this invention.

FIG. 6 shows a modified embodiment of the embodiment of FIG. 5, in which pitch detecting means 24 is inserted between the input terminal of each timbre forming device and the control means 22 of the parameter setting device 20. The pitch detecting means 24 detects the fundamental frequency of the musical sound signal of the open string in the input signal and supplies it to the control means 22 as the fundamental frequency $f_0$ of Equation (2). Therefore, it becomes easy to respond to such a case in which only tuning of the open string is changed as leaving the other values of Equation (2) unchanged. The pitch detecting means 24 may be provided for either each sound source (string) or all sound sources in common for sequential switching thereof.

The above-mentioned comb filters and other filters can be realized as digital filters. In this case, however, an A/D convertor is needed between the pickup and the timbre forming device and a D/A convertor is needed before the final sound system.

Although the above-mentioned timbre forming device can modify singular timbre attributable to a lot of higher harmonic included due to the actual pickup position to some extent, it cannot remove the influence of original timbre. In order to completely remove this influence, it is necessary to flatten the frequency characteristic of the original string vibration signal from the pickup to obtain a natural musical sound signal, before the vibration signal is applied to the above-mentioned timbre forming device. A frequency characteristic compensation device therefor can be constituted as follows.

Figure 7:
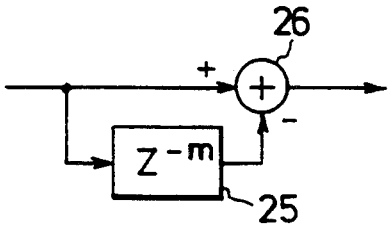
Figure 8:
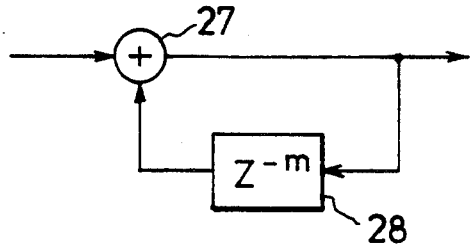

A signal having dips at high harmonic frequencies determined by the pickup position as shown in FIG. 3 can be realized by a digital filter and a transfer function H(Z) of the filter is given by $1-Z^{-m}$ as well known in the art, where $m=f_s/L$, $f_0$ is the fundamental frequency of an open string having a length L and $f_s$ is the sampling frequency, as aforementioned. The digital filter can be composed, as shown in FIG. 7, for example, of a delay 25 for delaying a sample signal of the output signal of the pickup by an amount of m samplings and an adder-subtractor 26 for subtracting the delayed output of the delay 25 from the current sample signal. In order to correct and flatten such frequency characteristic, the output signal of the pickup may be passed through a comb filter having a frequency characteristic opposite to the former frequency characteristic. In order to compose a comb filter having such opposite frequency characteristic, it is enough to make its transfer function $1/(1-Z^{-m})$. A digital filter having such transfer function can be composed, as shown in FIG. 8, for example, of an adder 27 having one input supplied with the sample signal and a delay 28 for delaying the output of the adder 27 by the amount of m samplings and supplying it again to another input of the adder 27. However, since it becomes easy to oscillate with this configuration, it is desirable to attenuate the output of the delay 28 before application to the adder 27 in order to prevent it.

Figure 9:
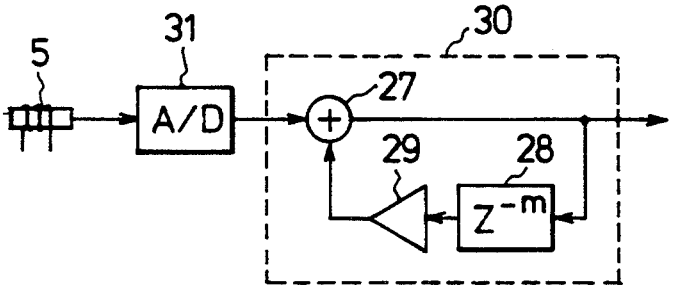

FIG. 9 shows an embodiment of frequency characteristic compensation device according to the above-mentioned principle. The frequency characteristic compensation device 30 comprises an adder 27 for receiving in one input terminal thereof the string vibration signal from the pickup 5 which has been sampled by an A/D convertor 31 at the sampling frequency $f_s$ and then digitized, a delay 28 for delaying the output of the adder 27 by an m sampling time, and an attenuator (amplifier) 29 for attenuating the output of the delay 28 for the above-mentioned reason and applying it to the other input of the adder 27. The multiplication factor in the attenuator 29 is less than one and 0.5 to 0.6, for example. For instance, the delay 28 may be composed of a shift register of plural stages and arranged to read the stored value from the m-th stage using a pointer. This enables the delay time to be variable and it is suitable when L and $f_0$ vary as in the case where the string is vibrated as being pressed, for example.

Figure 10:
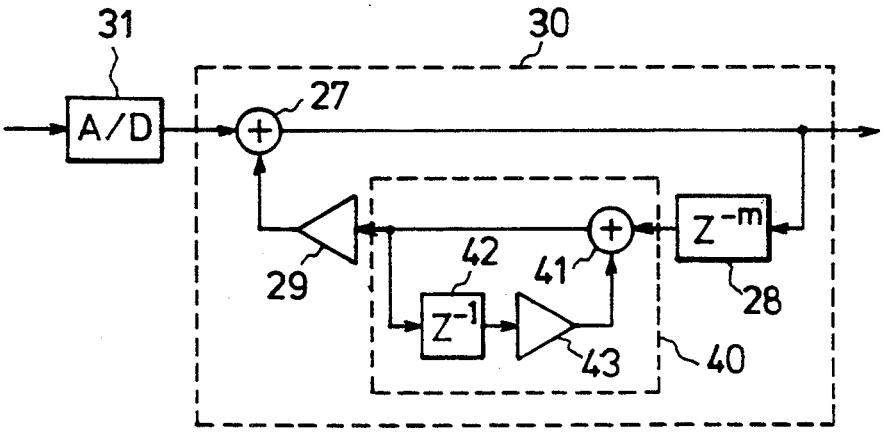
FIG. 10 is a block diagram showing another embodiment of the frequency characteristic compensation device of this invention.

The embodiment of FIG. 10 is a modification of the embodiment of FIG. 9 and it includes a lowpass filter 40 disposed between the delay 28 and attenuator 29 for preponderantly correcting a low frequency portion which can not be corrected completely by the compensation device of FIG. 9 but is relatively noticeable to auditory sense. The lowpass filter 40 includes an adder 41 for receiving the output of the delay 28 in one input thereof, a delay 42 for delaying the output of the adder 41 by one sampling time, and an attenuator (multiplier) 43 for attenuating the output of the delay 42 and applying it to the other input of the adder 41, and the multiplication factor of the attenuator 43 has a suitable value less than one. Since only the low frequency portion is fed back to the adder 27 by the lowpass filter 40, there is less oscillation than in the embodiment of FIG. 9 and the multiplication factor of the attenuator can be increased to the order of 0.8, for example. The lowpass filter 40 may be disposed either in the input side of the delay 28 or in the output side of the attenuator 29.

Figure 11:
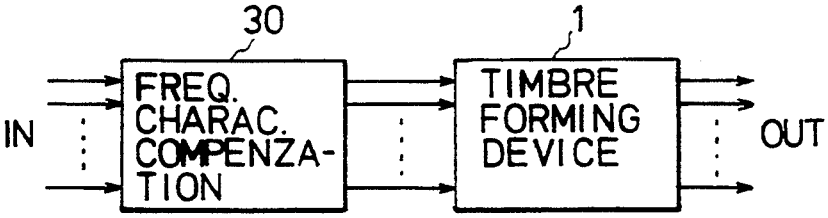
FIG. 11 is a block diagram showing the timbre forming device of this invention provided with the frequency characteristic compensation device of this invention.

As described above, according to this invention, it is possible to completely remove the influence of undesirable timbres, added by the pickup position, from the string vibration signal detected by the pickup. Therefore, it is possible to obtain a natural musical sound signal having a timbre formed regardless of the pickup position, if the string vibration signal from the pickup is first passed through the compensation device 30 and, thereafter, supplied to the aforementioned timbre forming device 1, as shown in FIG. 11. In this case, the same effect is obtainable even if the order of compensation device 30 and timbre forming device 1 is inverted.

It should be noted that the above embodiments have been submitted for illustrative purpose only and do not mean any limitation of the invention. It is a matter of course that various modifications and changes can be made on these embodiments without leaving the spirit and scope of the invention as defined in the appended claims.

I claim:

1. A musical tone signal forming device for an electric string music instrument having at least one pickup for detecting and delivering vibration of a string as an electric musical sound signal, comprising:

at least one comb filter having said electric musical sound signal as an input therefor; and means for producing parameters corresponding to a specific position, which differs from a position of said pickup with respect to said string, at which an imaginary pickup is disposed and a reference vibration frequency of said string and supplying said parameters to said at least one comb filter to determine a frequency characteristic of said at least one comb filter, wherein said frequency characteristic of said at least one comb filter simulates a frequency characteristic of said electric musical sound signal delivered from said imaginary pickup disposed at said specific position.

2. A musical tone signal forming device for an electric string music instrument having at least one pickup for detecting and delivering vibration of a string as an electric musical sound signal, comprising:

at least one comb filter having said electric musical sound signal as an input thereof; and means for producing parameters corresponding to a specific position, which differs from the position of said pickup with respect to said string, at which an imaginary pickup is disposed and a reference vibration frequency of said string and supplying said parameters to said at least one comb filter to determine a frequency characteristic of said comb filter, wherein said frequency characteristic of said at least one comb filter simulates dips appearing in higher harmonic frequencies of said electric musical sound signal delivered from said imaginary pickup disposed at said specific position.

3. A timbre forming device as set forth in claim 2, wherein said parameter supplying means include means for detecting the pitch of said input electric musical sound signal therefrom and determining said parameters to be supplied based thereupon.

4. A timbre forming device as set forth in claim 2, wherein said parameter supplying means include means for storing said parameters or information for calculating said parameters.

5. A timbre forming device as set forth in claim 3, wherein said parameter supplying means include means for storing said parameters or information for calculating said parameters.

6. A timbre forming device as set forth in claim 2, wherein said parameter supplying means include means for manually setting said parameters or information for calculating said parameters.

7. A timbre forming device as set forth in claim 3, wherein said parameter supplying means include means for manually setting said parameters or information for calculating said parameters.

8. A musical tone signal forming device for an electric string music instrument having a plurality of strings and a plurality of pickups for individually detecting and delivering vibrations of said plurality of strings as a plurality of electric musical sound signals, comprising:

a plurality of comb filters having said plurality of said electric musical sound signals as their inputs, respectively, and means for producing parameters corresponding to a plurality of specific positions, which differ from the positions of said plurality of pickups with respect to said plurality of strings, at which a plurality of imaginary pickups are disposed and a plurality of reference vibration frequencies of said plurality of strings and supplying said parameters to said plurality of comb filters to determine a frequency characteristic of each of said plurality of comb filters, wherein said frequency characteristic of each of said plurality of comb filters simulates a frequency characteristic of said electric musical sound signals delivered from said plurality of imaginary pickups disposed at said plurality of specific positions.

9. A timbre forming device as set forth in claim 8, wherein said parameter supplying means include means for detecting the pitch of each said input electric musical sound signal therefrom and determining said parameters to be supplied based thereupon.

10. A timbre forming device as set forth in claim 8, wherein said parameter supplying means include means for storing said parameters or information for calculating said parameters.

11. A timbre forming device as set forth in claim 9, wherein said parameter supplying means include means for storing said parameters or information for calculating said parameters.

12. A timbre forming device as set forth in claim 8, wherein said parameter supplying means include means for manually setting said parameters or information for calculating said parameters.

13. A timbre forming device as set forth in claim 9, wherein said parameter supplying means include means for manually setting said parameters or information for calculating said parameters.

14. A device for compensating a frequency characteristic of an electric string music instrument having at least one pickup for detecting and delivering vibration of a string as an electric musical signal, said at least one pickup having said frequency characteristic in an output signal thereof relating to a position of said at least one pickup with respect to said string, comprising:

a filter having a frequency characteristic opposite to the frequency characteristic of said output signal, and means for producing parameters corresponding to the position of said at least one pickup and a reference vibration frequency of said string and supplying said parameters to said filter, wherein said frequency characteristic opposite to the frequency characteristic of said output signal is a frequency characteristic which compensates for dips appearing in a higher harmonic frequency determined with said position of said at least one pickup with respect to said string.

15. A device as set forth in claim 14, wherein said filter includes a lowpass filter.

16. A device as set forth in claim 14, wherein said filter is a comb filter which produces a peak at said higher harmonic frequency in which said dips appear.

17. A device as set forth in claim 16, wherein said comb filter includes a lowpass filter.

18. A musical tone signal forming device for an electric string music instrument having a plurality of strings, a plurality of pickups for individually detecting vibrations of said plurality of strings to deliver a plurality of electric musical sound signals, each of said plurality of pickups having an output signal including a frequency characteristic relating to a position of said each of said plurality of pickups with respect to each said string, comprising:

frequency characteristic compensating means having a frequency characteristic which compensates for dips appearing in higher harmonic frequencies determined with the positions of said of said plurality of pickups with respect to said strings, and musical tone signal forming means for subjecting said output signal to musical tone signal formation, wherein said frequency characteristic compensating means and said musical tone signal forming means are connected in series.

19. A musical tone signal forming device as set forth in claim 18, wherein said musical tone signal forming means comprises a plurality of comb filters each of said plurality of comb filters corresponding respectively to one of said plurality of electric musical sound signals, and means for supplying parameters which determine a frequency characteristic of each of said plurality of comb filters to each of said plurality of comb filters, wherein said frequency characteristic of each of said plurality of comb filters determined with said parameters supplied by said means for supplying parameters simulates dips appearing in higher harmonic frequencies of said plurality of electric musical sound signals delivered from an imaginary pickup located at a position other than the position of each of said plurality of pickups.

20. A timbre forming device as set forth in claim 19, wherein said parameter supplying means is provided with means for detecting the pitch of said input electric musical sound signal therefrom and determining said parameters to be supplied based thereupon.

21. A musical tone signal forming device as set forth in claim 1, wherein said parameter supplying means include means for detecting the pitch of said input electric musical sound signal therefrom and determining said parameters to be supplied based thereupon.

22. A musical tone signal forming device as set forth in claim 1, wherein said parameter supplying means include means for storing said parameters or information for calculating said parameters.

23. A musical tone signal forming device as set forth in claim 1, wherein said parameter supplying means include means for manually setting said parameters or information for calculating said parameters.

24. A musical tone signal forming device for an electric string music instrument having a plurality of strings and a plurality of pickups for individually detecting and delivering vibrations of said plurality of strings as a plurality of electric musical sound signals, comprising:

a plurality of comb filters having said plurality of said electric musical sound signals as their inputs, respectively, and means for producing parameters corresponding to a plurality of specific positions, which differ from the positions of said plurality of pickups with respect to said plurality of strings, at which a plurality of imaginary pickups are disposed and a plurality of reference vibration frequencies of said plurality of strings and supplying said parameters to said plurality of comb filters to determine a frequency characteristic of each of said plurality of comb filters, wherein each frequency characteristic of each of said plurality of comb filters simulates dips appearing in higher harmonic frequencies of said electric musical sound signals delivered from said plurality of imaginary pickups disposed at said plurality of specific positions.

* * * * *